US009278537B2

(12) United States Patent
Tanaka

(10) Patent No.: US 9,278,537 B2
(45) Date of Patent: Mar. 8, 2016

(54) LIQUID EJECTING APPARATUS

(71) Applicant: SEIKO EPSON CORPORATION, Tokyo (JP)

(72) Inventor: Shinichi Tanaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/224,982

(22) Filed: Mar. 25, 2014

(65) Prior Publication Data

US 2014/0292921 A1 Oct. 2, 2014

(30) Foreign Application Priority Data

Mar. 29, 2013 (JP) ..... 2013-071608

(51) Int. Cl.

| | |
|---|---|
| ***B41J 2/17*** | (2006.01) |
| ***B41J 3/28*** | (2006.01) |
| ***B41J 11/00*** | (2006.01) |
| ***B41J 29/02*** | (2006.01) |
| ***B41J 29/377*** | (2006.01) |

(52) U.S. Cl.

CPC *B41J 2/1714* (2013.01); *B41J 3/28* (2013.01); *B41J 11/002* (2013.01); *B41J 29/02* (2013.01); *B41J 29/377* (2013.01)

(58) Field of Classification Search

None

See application file for complete search history.

(56) References Cited

U.S. PATENT DOCUMENTS

2014/0292920 A1 * 10/2014 Shibata et al. ..... 347/34

FOREIGN PATENT DOCUMENTS

| | | |
|---|---|---|
| JP | 2010-000735 | 1/2010 |
| JP | 2010-058441 | 3/2010 |
| JP | 2011-143657 | 7/2011 |
| JP | 2012-187583 | 10/2012 |

* cited by examiner

*Primary Examiner* — Justin Seo

(74) *Attorney, Agent, or Firm* — Workman Nydegger

(57) ABSTRACT

A liquid ejecting apparatus includes a support stage; a liquid ejecting unit that ejects an ink; an ultraviolet irradiation unit that has an intake port, an exhaust port and a filter; a guide axis that supports the liquid ejecting unit and the ultraviolet irradiation unit; an X-axis driving mechanism that moves the liquid ejecting unit and the ultraviolet irradiation unit; a liquid ejecting portion that has the guide axis and the X-axis driving mechanism; and a ventilation fan that causes a gas to flow between the liquid ejecting portion and the support surface. The ultraviolet irradiation unit is supported by the X-axis driving mechanism on a rear side. The exhaust port is arranged on a front side, and the intake port is arranged thereabove.

6 Claims, 13 Drawing Sheets

LIQUID EJECTING APPARATUS

BACKGROUND

1. Technical Field

The present invention relates to a liquid ejecting apparatus that ejects a liquid.

2. Related Art

In the related art, there is a known liquid ejecting apparatus in this type provided with a table on which media are mounted, a recording head which ejects an ink to the media, a Y-bar which holds the recording head to be movable in a scanning direction, and an air flow generation mechanism which generates an air flow (in a gap) between the recording head and the media (refer to JP-A-2011-143657). This air flow generation mechanism removes an ink mist and the like scattered on the media by generating the air flow between the recording head and the media.

However, in a recording apparatus in the related art, since an ink mist is removed by generating the air flow around only the gap between the recording head and the media in the configuration, the ink mist scattered above the media can be removed, but there is a problem that the ink mist scattered more upper cannot be removed effectively. In other words, the air flow is not generated by the air flow generation mechanism in a space other than the surroundings of the gap, and thus, an atmosphere including the ink mist stays. As a result, the ink mist adheres to a mechanism (for example, control linear scale provided in Y-bar) positioned in the space, thereby causing a problem of occurrence of inconvenience in a recording control and the like.

SUMMARY

An advantage of some aspects of the invention is to provide a liquid ejecting apparatus that can effectively remove an ink mist on a liquid ejecting portion throughout a wide range.

According to an aspect of the invention, there is provided a liquid ejecting apparatus includes a stage that has a support surface supporting a medium; a liquid ejecting unit that ejects a liquid to the medium supported by the stage; an intake/exhaust portion that has an intake port, an exhaust port, a flow channel which connects the intake port and the exhaust port to communicate with each other, and a capturing portion which captures the liquid; a support portion that supports the liquid ejecting unit and the intake/exhaust portion; a moving portion that moves the liquid ejecting unit and the intake/exhaust portion supported by the support portion in a first direction; a liquid ejecting portion that has the support portion and the moving portion; and an air flow generation portion that causes a gas to flow between the liquid ejecting portion and the support surface. The intake/exhaust portion is supported by the moving portion on one side in a second direction orthogonal to the first direction. The exhaust port is arranged on the other side opposite to one side in the second direction, and the intake port is arranged above the exhaust port.

In this case, since the mist of the liquid moves downwind of the air flow for air exhaust by the air flow generation portion, it is possible to discharge most of the mist to the outside of the apparatus. The mist remaining inside the apparatus can be captured by the intake/exhaust portion. As illustrated in FIG. 10A, an air flow which flows above from the exhaust port of the intake/exhaust portion as drawing an arc and reaches the intake port of the intake/exhaust portion, and an air flow which flows below from the exhaust port of the intake/exhaust portion as drawing an arc and reaches the surroundings of the support surface of the stage are generated by the air flow generation portion and the intake/exhaust portion, and thus, the mist of the liquid moves downwind of these two air flows to be collected/removed. In such a manner, since the removal to the outside of the apparatus is performed with the capturing inside the apparatus, it is possible to effectively remove the mist on the liquid ejecting portion throughout a wide range.

It is preferable that the liquid ejecting portion include an apparatus cover which covers the liquid ejecting unit and the intake/exhaust portion, and the apparatus cover have a facing portion which faces the exhaust port.

In this case, since the exhaust of the intake/exhaust portion is branched upward and downward by colliding the facing portion of the apparatus cover, it is possible to suitably generate the air flow which circulates inside the apparatus cover about the intake/exhaust portion. Accordingly, it is possible to effectively remove the mist.

It is preferable that a plurality of the intake/exhaust portions are included, and the liquid ejecting unit be arranged between the plurality of the intake/exhaust portions in the first direction.

In this case, two intake/exhaust portions are provided to be adjacent to the liquid ejecting unit which is an origin of generating the mist, and thus, it is possible to more effectively collect the ink mist which has just generated.

It is preferable that the intake/exhaust portion include an electromagnetic wave irradiation portion which cures a liquid having an electromagnetic wave curing characteristic; a filter which captures the liquid; and a heat sink which is arranged between the filter and the exhaust port and cools the electromagnetic wave irradiation portion.

In this case, the atmosphere on the liquid ejecting portion which is taken into the intake/exhaust portion is discharged out of the intake/exhaust portion through the filter and the heat sink. In this manner, the air flow in accordance with the intake air and exhaust air of the intake/exhaust portion can be adopted for cooling the heat sink, and thus, it is possible to simultaneously perform the cooling of the electromagnetic irradiation portion with the collecting of the mist.

It is preferable that a controller switch between a first mode to drive the liquid ejecting unit and the intake/exhaust portion, and a second mode to drive the intake/exhaust portion without driving the liquid ejecting unit.

In this case, it is possible to collect the mist even when there is no need for the liquid ejecting operation to be performed by providing the second mode that drives the intake/exhaust portion without driving the liquid ejecting unit.

According to the aspect of the invention, a flow velocity increasing portion is further included which increases a flow velocity of the gas, and the controller drives the flow velocity increasing portion and increases the flow velocity of the gas flowing between the liquid ejecting portion and the support surface in the second mode.

In this case, it is possible to remove the mist much more in the second mode.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid ejecting apparatus according to the embodiment of the present invention will be described with reference to the accompanying drawings. This liquid ejecting apparatus records a desired image on a recording medium (medium) by ejecting an ultraviolet curing ink (active energy curing ink) through an ink jet method. The liquid ejecting apparatus is a so-called flatbed-type liquid ejecting apparatus which performs recording by moving a liquid ejecting head with respect to the recording medium supported by a support stage. As the recording medium, for example, recording media with different thickness from each other such as cardboard, wood, tile, a plastic board, a styrene board and corrugated cardboard are conceived. As illustrated in each drawing, an X-axis (lateral) direction, a Y-axis (front/rear) direction and a Z-axis (vertical) direction are defined for descriptions hereinafter. The side in the front of FIG. 1 is a front side of the liquid ejecting apparatus, and the side in the rear of FIG. 1 is a rear side of the liquid ejecting apparatus.

Figure 1:
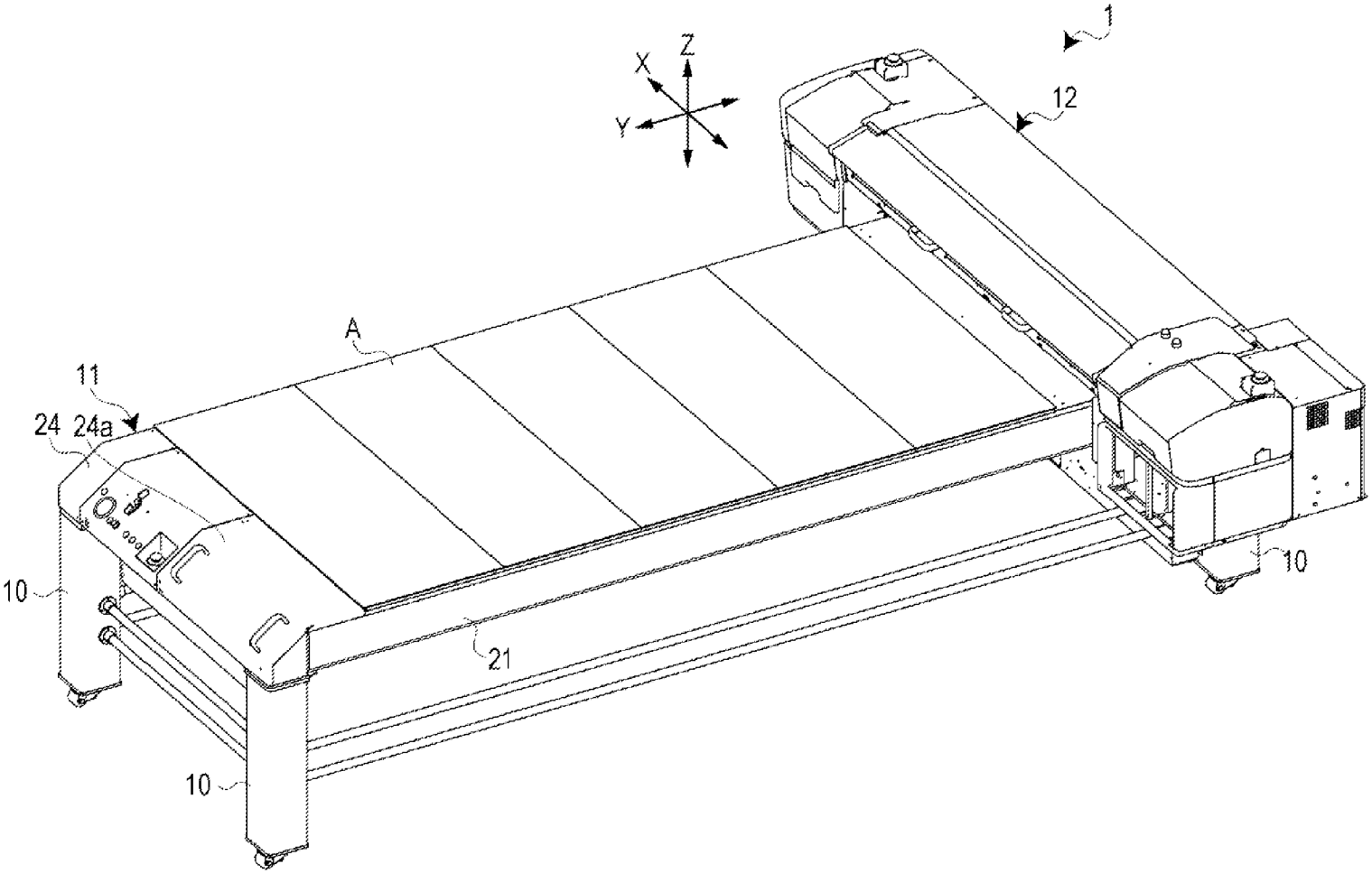
FIG. 1 is a perspective view illustrating the appearance of a liquid ejecting apparatus according to an embodiment.
Figure 2A:
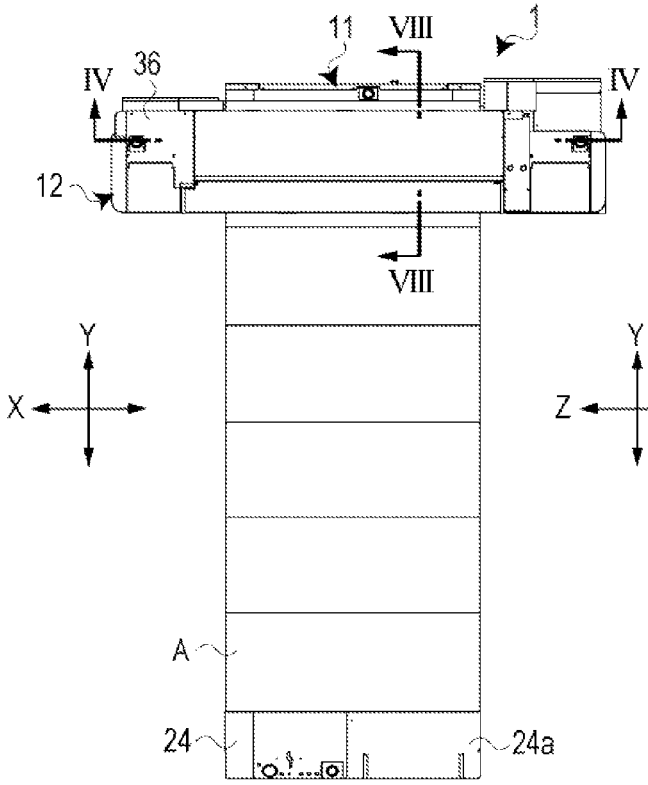
FIG. 2A is a plan view of the liquid ejecting apparatus.
Figure 2C:
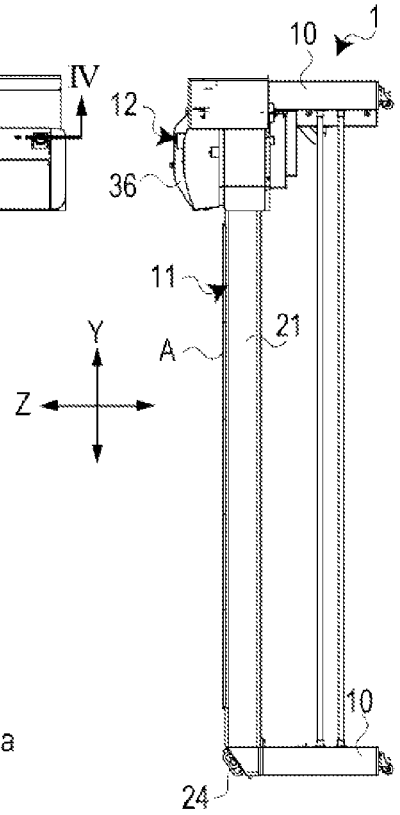
FIG. 2C is a side view thereof.
Figure 2B:
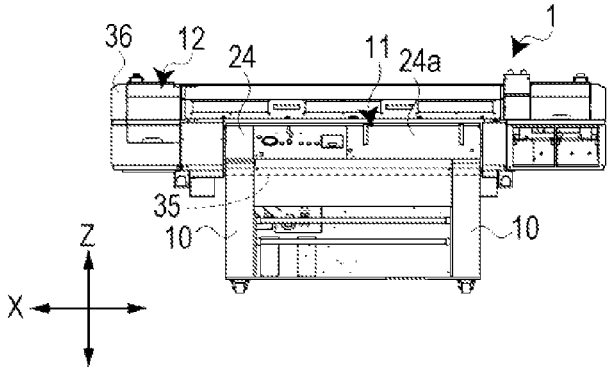
FIG. 2B is a front view thereof.
Figure 3:
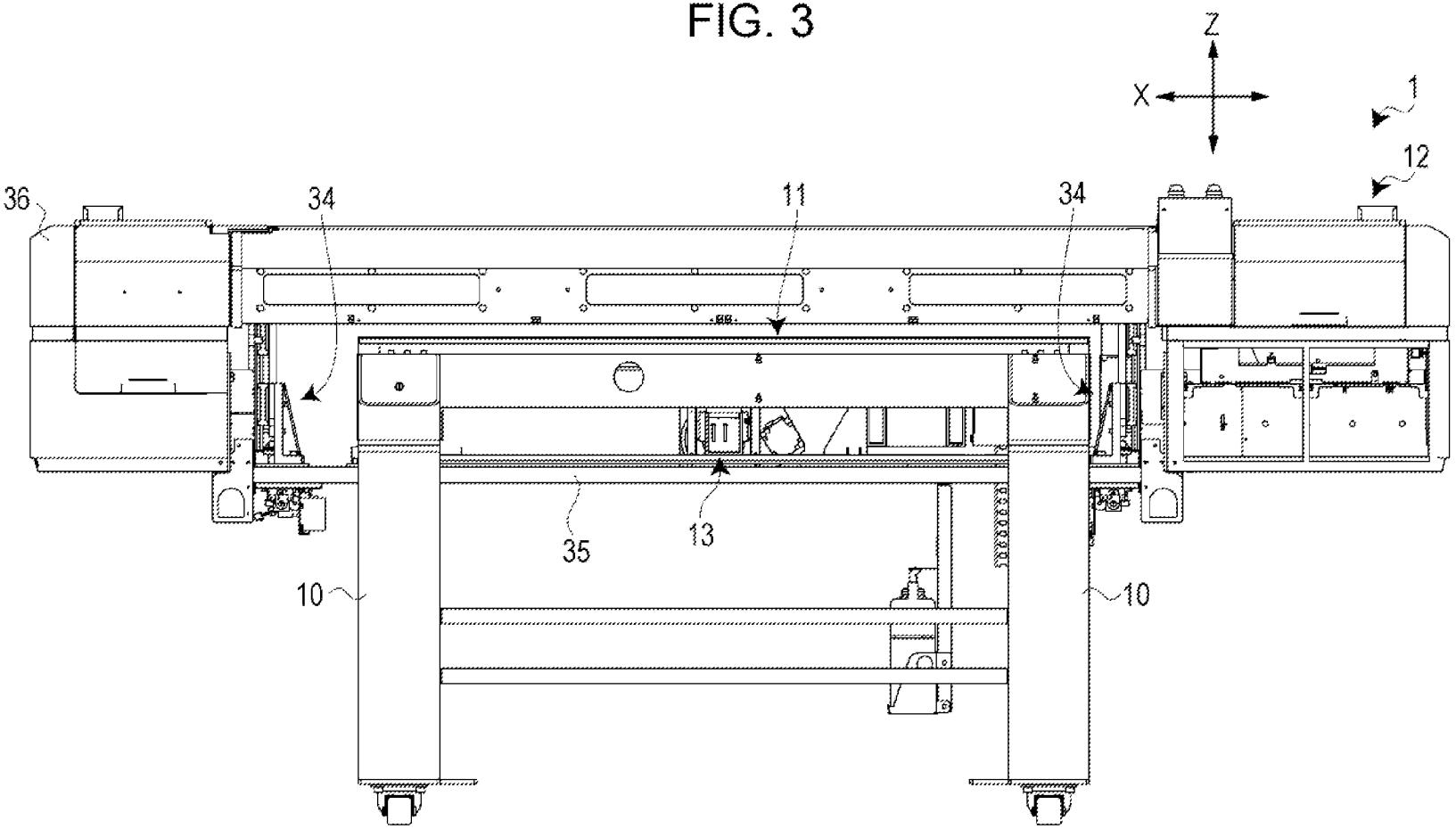
FIG. 3 is a front view illustrating the liquid ejecting apparatus of which a portion of a support stage and a portion of an apparatus cover are not illustrated.

As illustrated in FIGS. 1 to 3, a liquid ejecting apparatus 1 is provided with a support stage (stage) 11 that is supported by four leg members 10 and supports a recording medium A, a liquid ejecting portion 12 that has a head unit 31 confronting the supported recording medium A, an Y-axis moving portion 13 that supports the liquid ejecting portion 12 and moves the liquid ejecting portion 12 in the Y-axis direction (second direction) with respect to the support stage 11, and a controller 14 (refer to FIG. 13) that controls each of the portions. The liquid ejecting portion 12 makes a bridge over the support stage 11 so as to across in the X-axis direction (first direction). Meanwhile, the Y-axis moving portion 13 is arranged to overlap with the support stage 11 on a rear surface side (surface on side opposite to liquid ejecting portion 12 side) of the support stage 11, and movably supports the liquid ejecting portion 12 on the rear surface side of the support stage 11.

Figure 4:
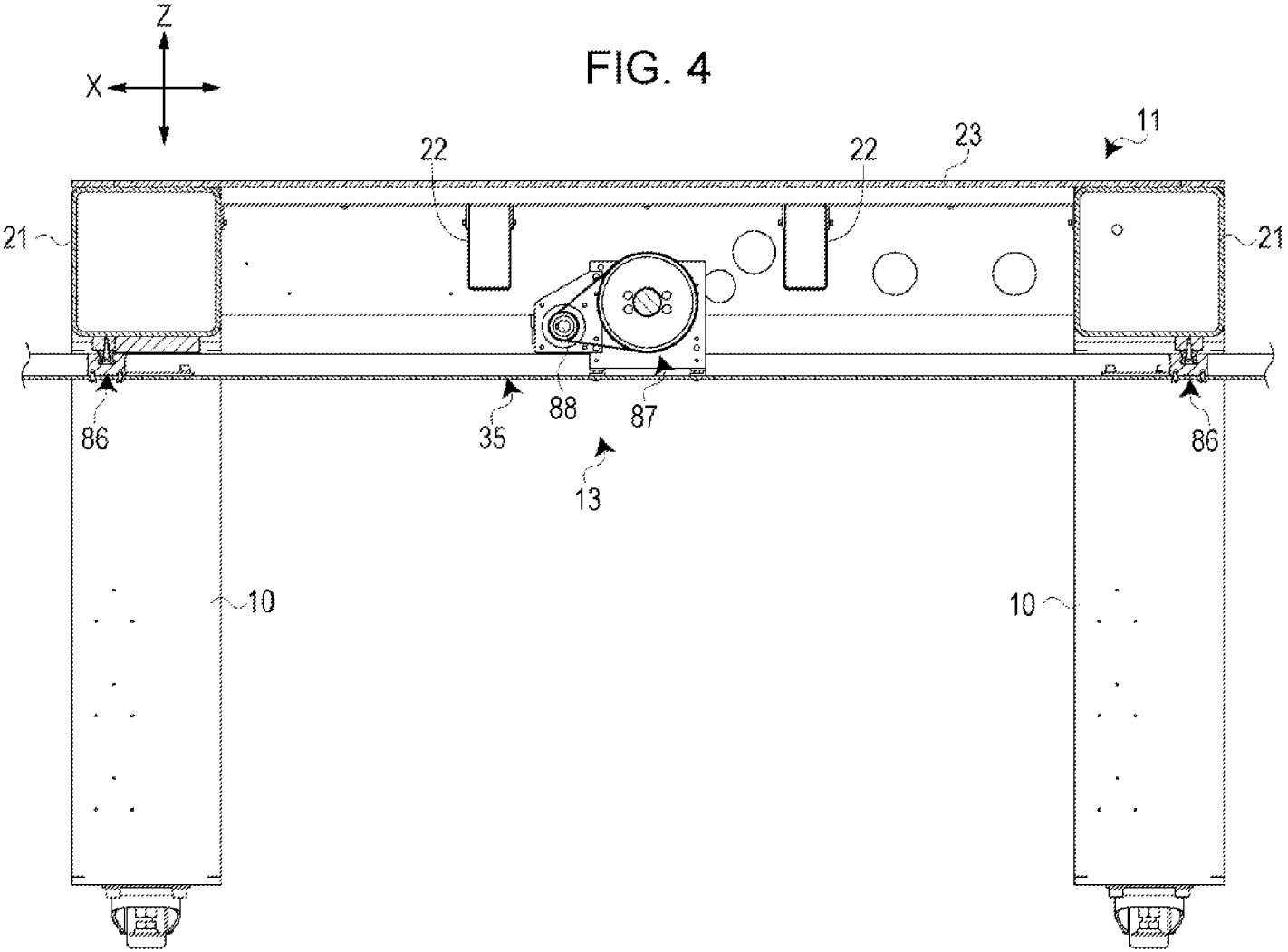
FIG. 4 is a cross-sectional view taken along line IV-IV illustrating surroundings of the support stage and a Y-axis moving portion.

Next, the support stage 11 will be described with reference to FIGS. 1, 2A, 2B, 2C and 4. FIG. 4 is a cross-sectional view of surroundings of the support stage 11 and the Y-axis moving portion 13 seen from a rear side taken along line IV-IV. As illustrated in FIGS. 1, 2A, 2B, 2C and 4, the support stage 11 has a pair of right and left structural angles 21 in beam shapes which extends in the Y-axis direction, a plurality of support materials 22 which are arranged lengthwise and crosswise between the pair of structural angles 21, and an adsorption table 23 which is supported by the pair of structural angles 21 and the plurality of support materials 22 and to which the recording medium A is adsorbed and set. End portions of each of the structural angles 21 are respectively connected to the leg members 10 by welding and the like. An operation panel portion 24 is arranged in a front end portion of the support stage 11. An opening/closing door 24*a* is disposed widely in a right half portion of the operation panel portion 24. When performing maintenance for the liquid ejecting portion 12 manually, the liquid ejecting portion 12 is moved to a side of the front (front side), and the opening/closing door 24*a* is opened to perform the maintenance for the liquid ejecting portion 12 through the opening/closing door 24*a*.

Figure 5:
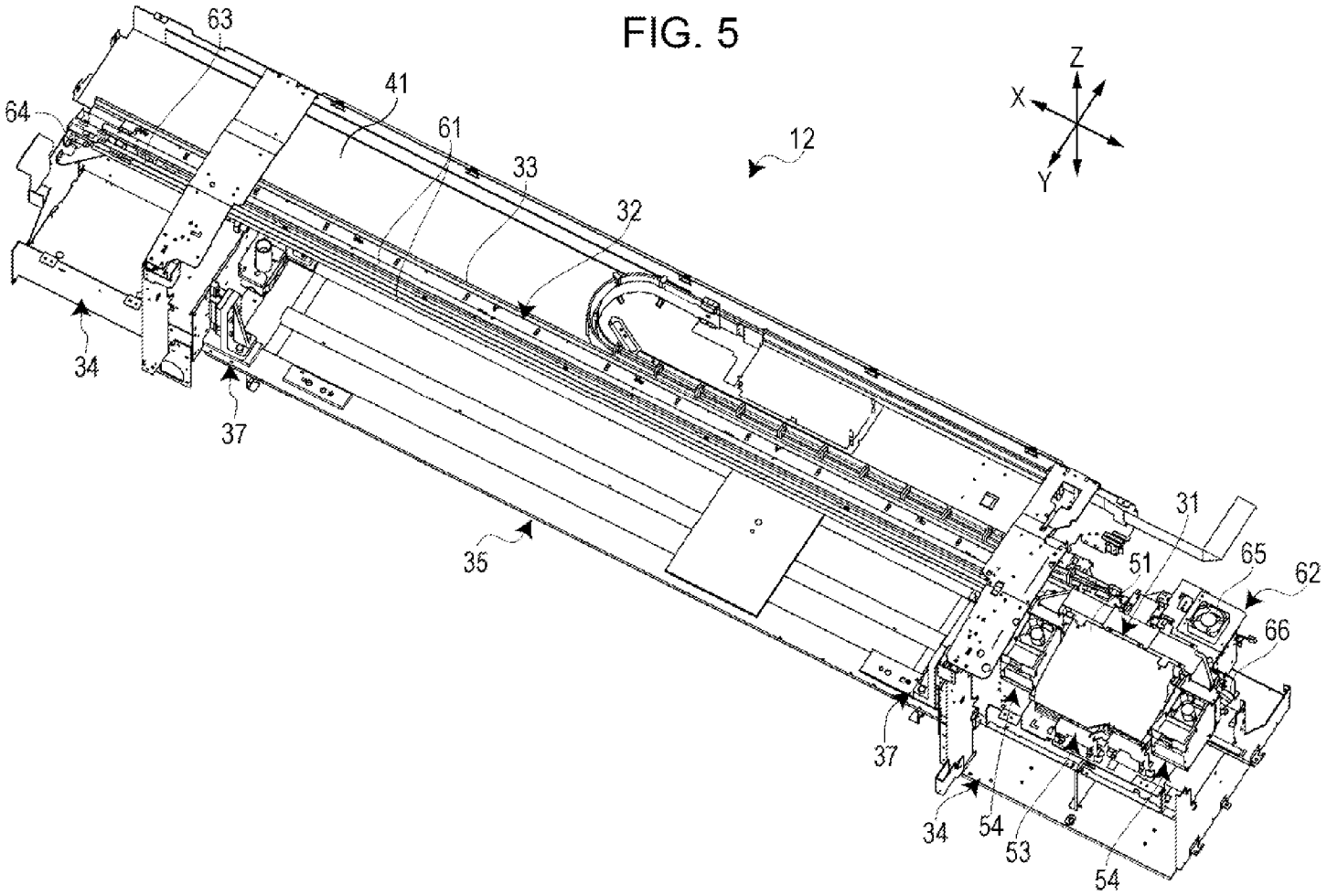
FIG. 5 is a perspective view illustrating a liquid ejecting portion of which the apparatus cover is not illustrated.
Figure 6:
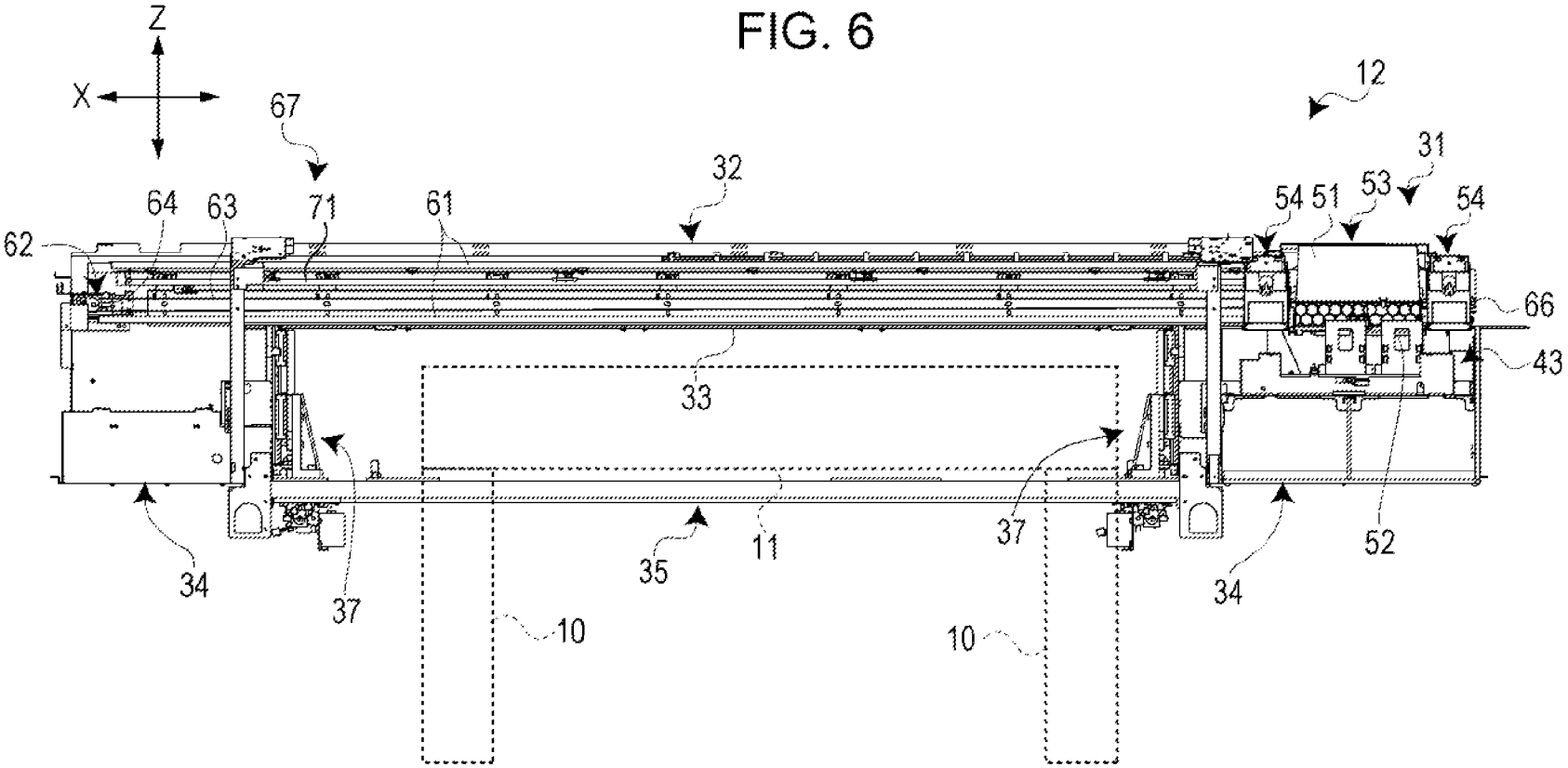
FIG. 6 is a front view illustrating a liquid ejecting portion of which the apparatus cover is not illustrated.

As illustrated in FIGS. 5 and 6, the liquid ejecting portion 12 includes a head unit 31 confronting the recording medium A, an X-axis moving portion 32 which supports the head unit 31 on a rear side and moves the head unit 31 in the X-axis direction, a horizontal bridge frame 33 which supports the X-axis moving portion 32, a pair of right and left side frames 34 which supports the horizontal bridge frame 33 on both sides in the X-axis direction, a connection frame 35 which connects base portion sides of the pair of side frames 34 with each other, an apparatus cover (refer to FIG. 1) 36 which covers these components, and a ventilation portion 38 (refer to FIG. 8) which is disposed on a rear surface wall 36*b* of the apparatus cover 36 and removes an ink mist. This ink mist is generated in accordance with ejection of an ink by the liquid ejecting head 52.

The liquid ejecting portion 12 has a plate-shaped member 41 which is arranged on the rear side of the horizontal bridge frame 33 in the Y-axis direction and holds an ink tube or a cable, and a maintenance unit 43 which is arranged in a right end portion and promotes maintenance and recovery in function of the liquid ejecting head 52.

The horizontal bridge frame 33 extends in the X-axis direction so as to cross over the support stage 11. Each of the side frames 34 extends below the support stage 11, and the connection frame 35 is connected to lower end portions of both the side frames 34 on a lower side of the support stage 11. An up/down moving portion 37 which moves the head unit 31 up and down is embedded in each of the side frames 34 through the horizontal bridge frame 33 and the X-axis moving portion 32. This up/down moving portion 37 brings the head unit 31 close to or away from the support stage 11 or the recording medium A in a vertical direction (gap adjustment).

Figure 7:
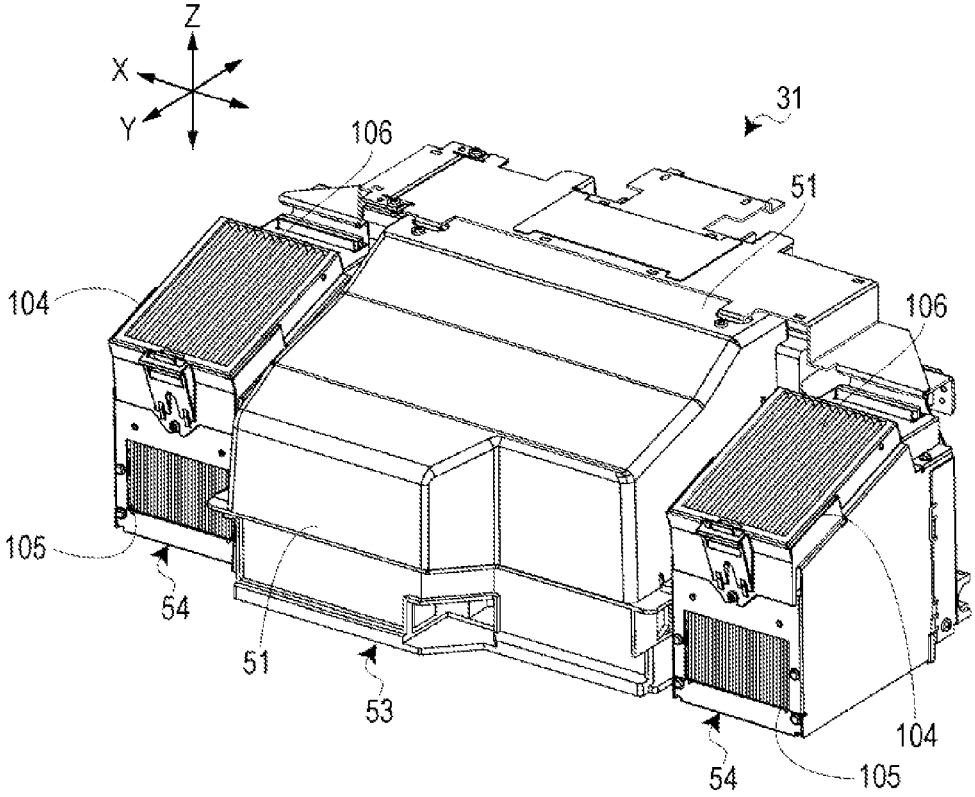
FIG. 7 is a perspective view illustrating a head unit.

As illustrated in FIG. 7, the head unit 31 has a liquid ejecting unit 53 in which two liquid ejecting heads 52 are mounted on a box-shaped carriage 51, and a pair of ultraviolet irradiation units (intake/exhaust portion) 54 which is arranged respectively adjacent to both sides of the liquid ejecting unit 53 in the X-axis direction. The liquid ejecting unit 53 and the pair of ultraviolet irradiation units 54 are individually supported by the X-axis moving portion 32 on their rear sides. The liquid ejecting unit 53 and the pair of ultraviolet irradiation units 54 are configured to move together by the X-axis moving portion 32. Each of the ultraviolet irradiation units 54 also functions as a mist collecting portion which collects the ink mist and will be described below in detail.

Each of the liquid ejecting heads 52 is an ink jet head which is driven to eject by a piezoelectric element (Piezo element) and has a plurality of nozzle rows (not illustrated) in colors extending in the Y-axis direction. In other words, the liquid ejecting head 52 is configured to be able to eject the ultraviolet curing inks in multiple colors. A nozzle surface of the liquid ejecting head 52 faces the recording medium A and ejects the ink downward. The nozzle surfaces of two liquid ejecting heads 52 are positioned at the same height. Although a piezo-type ink jet head is adopted in the embodiment, without being limited thereto, an ink jet head of a thermal method or an electrostatic method may be adopted, for example. Without being limited to these on-demand-type ink jet heads, a continuous-type ink jet head may be adopted.

As illustrated in FIGS. 5 and 6, the X-axis moving portion 32 has a pair of upper and lower guide axes (support portion) 61 which is supported by the horizontal bridge frame 33 and supports the head unit 31 to be able to reciprocate in the X-axis direction, an X-axis driving mechanism (moving portion) 62 which drives the head unit 31 along the pair of guide axes 61, and an X-axis detecting mechanism 67 which detects a moving position of the head unit 31 in the X-axis direction.

The X-axis driving mechanism 62 includes a timing belt 63 which extends in the X-axis direction along the pair of guide axes 61, a driving pulley 66 and a driven pulley 64 around which the timing belt 63 is wound, a connection fixing portion (not illustrated) which connects the timing belt 63 and the head unit 31, and a carriage motor 65 which drives the driving pulley 66. In the X-axis moving portion 32, the head unit 31 reciprocates in the X-axis direction of the pair of guide axes 61 through the timing belt 63 by reciprocally rotating the carriage motor 65.

The X-axis detecting mechanism 67 has a linear scale 71 which is disposed along the X-axis direction; and a detector 72 (refer to FIG. 13) which is fixed to the head unit 31, reads a scale of the linear scale 71, and detects a moving position of the head unit 31.

As illustrated in FIG. 4, the Y-axis moving portion 13 is arranged between the support stage 11 and the connection frame 35, and moves the liquid ejecting portion 12 in the Y-axis direction with respect to the support stage 11. The Y-axis moving portion 13 has a pair of linear guide mechanisms 86 which is positioned on both the right and left sides on the rear surface side of the support stage 11 and slides the liquid ejecting portion 12 in the Y-axis direction with respect to the support stage 11, a Y-axis moving mechanism 87 which is positioned in the center on the rear surface side of the support stage 11 and moves the liquid ejecting portion 12 in the Y-axis direction with respect to the support stage 11, and a driving motor 88 which drives the Y-axis moving mechanism 87. Each of the linear guide mechanisms 86 is configured of a LM guide (registered trademark) mechanism. The Y-axis moving mechanism 87 is configured of a ball screw mechanism.

Figure 8:
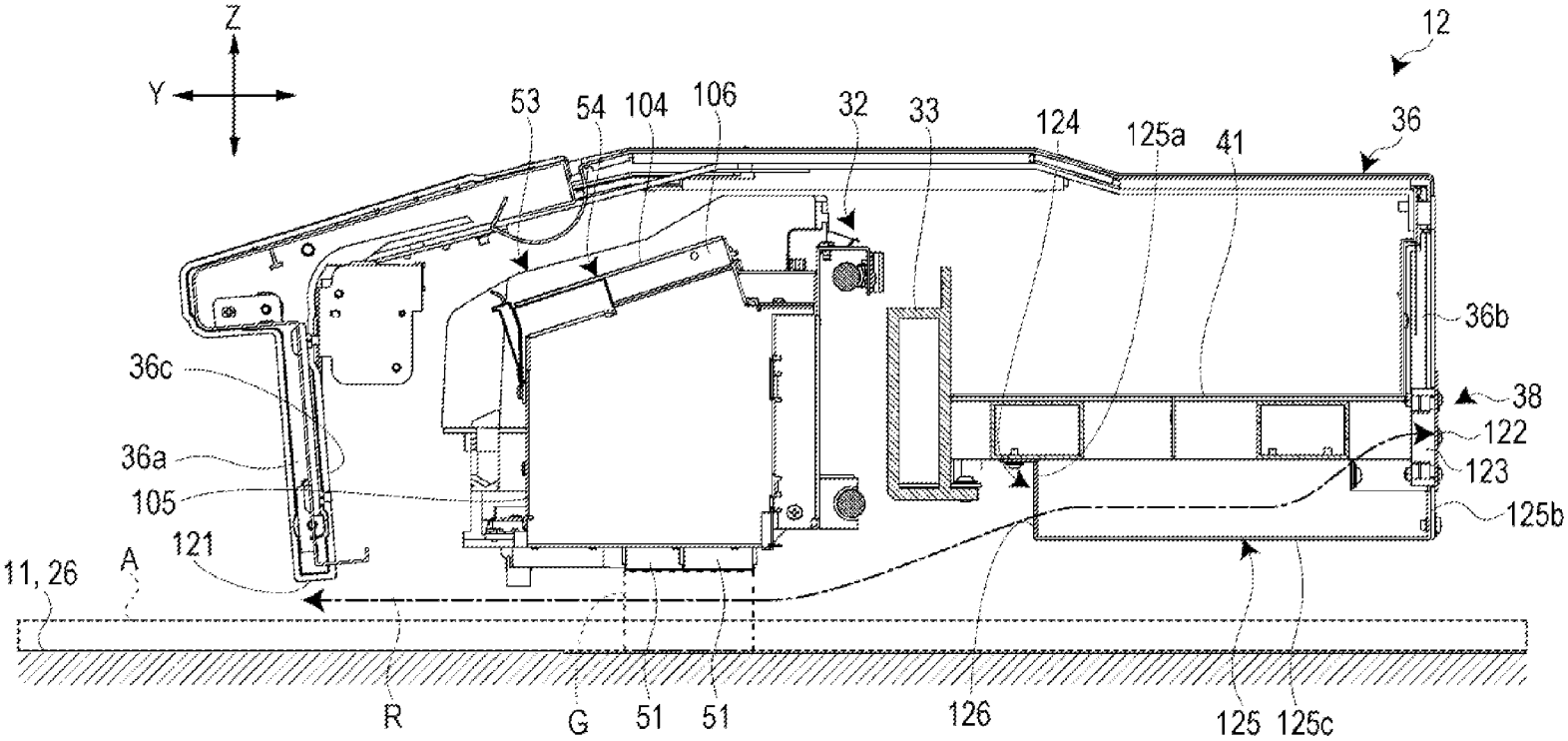
FIG. 8 is a cross-sectional view taken along line VIII-VIII illustrating surroundings of the head unit and a ventilation portion.
Figure 9:
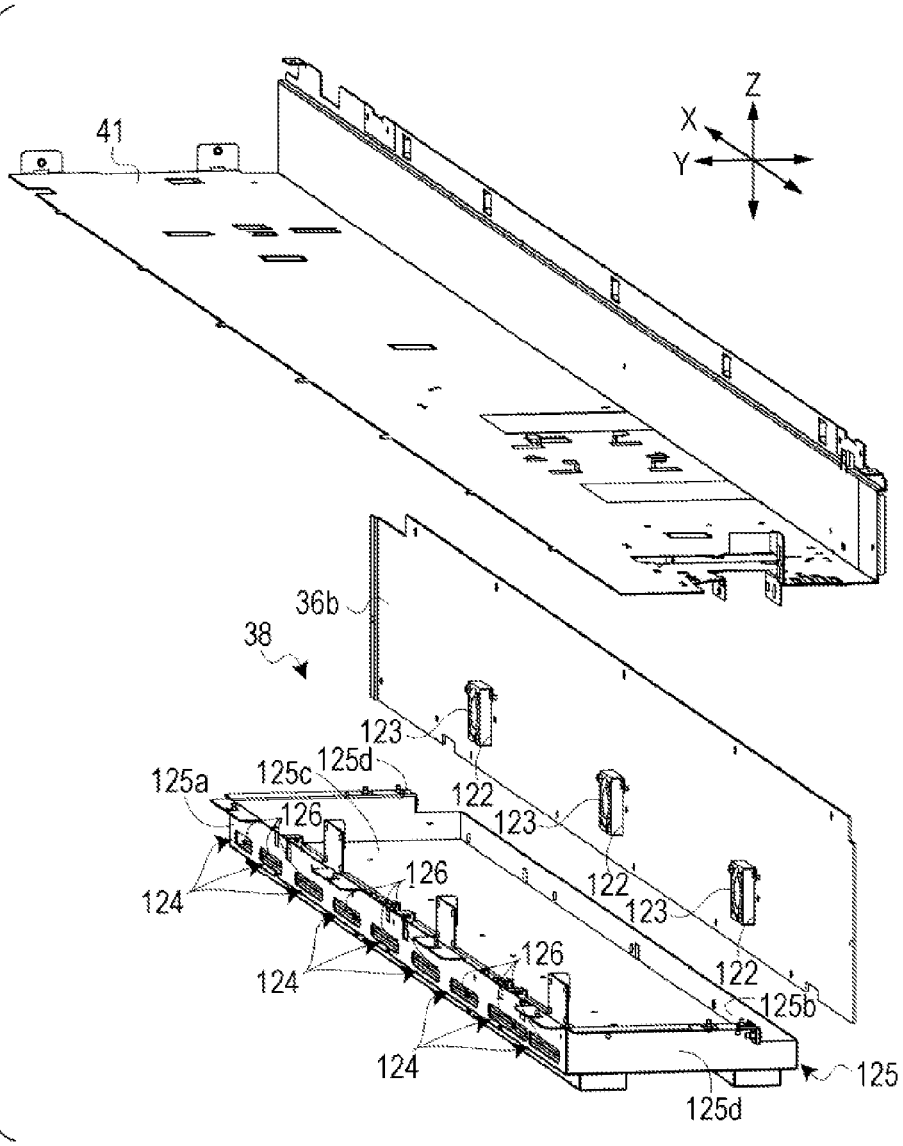
FIG. 9 is an exploded perspective view illustrating the surroundings of the ventilation portion.

Here, the ventilation portion 38 and the ultraviolet irradiation unit 54 will be described with reference to FIGS. 8 to 12. As illustrated in FIGS. 8 and 9, the ventilation portion 38 ventilates an atmosphere (including air and ink mist) around a gap space G between the liquid ejecting unit 53 and the support stage 11 or recording medium A supported thereby. The gap space G is a space between the liquid ejecting unit 53 which moves to each position in the X-axis direction facing the support stage 11, and the support stage 11. Specifically, the gap space G is a space between the nozzle surface of the liquid ejecting head 52 in the liquid ejecting unit 53 and a support surface of the support stage 11. In the liquid ejecting apparatus 1, an intake/exhaust flow channel R is provided from an opening 121 between a front surface wall 36*a* of the apparatus cover 36 and the support stage 11 (or recording medium A supported thereby) to a plurality of ventilation ports 122 which are disposed in a rear surface wall 36*b* of the apparatus cover 36 passing through the gap space G and a space in which the liquid ejecting unit 53 moves. The plurality of the ventilation ports 122 are arranged in parallel in the X-axis direction. The ventilation portion 38 leads air to flow through this intake/exhaust flow channel R and generates the air flow in the front/rear direction, and thus, the ink mist moves downwind of the air flow so as to be exhausted (removed) to the outside of the apparatus (outside apparatus cover 36). A flow channel direction of the intake/exhaust flow channel R is the Y-axis direction (front/rear direction). In the X-axis direction, a width of a region through which the ventilation portion 38 can intake and exhaust is set wider than a width of a recording region.

The ventilation portion 38 includes a plurality of ventilation fans (air flow generation portion) 123 which are respectively disposed in the plurality of ventilation ports 122, and a flow channel forming member 125 which has throttle portions (flow velocity increasing portion) 124 interposed between the plurality of ventilation fans 123 and the gap space G.

The flow channel forming member 125 is arranged to be close to the rear surface wall 36*b* of the apparatus cover 36 and is in a box shape constituted of a front wall 125*a*, a rear wall 125*b*, a bottom wall 125*c* and both side walls 125*d*. The front wall 125*a* of the flow channel forming member 125 has a plurality of slit portions 126, thereby forming a plurality of the throttle portions 124. The plurality of the throttle portions 124 are arranged in parallel in the X-axis direction and respectively have the slit portions 126. Each of the slit portions 126 is slit-shaped opening portion which extends in the X-axis direction. The plurality of the throttle portions 124 throttle the intake/exhaust flow channel R through each of the slit portions 126, thereby increasing a velocity of the air flow on a downstream side thereof. An opening area of the opening 121 is set wider than an opening area throughout the plurality of slit portions 126. The plurality of slit portions 126 are arranged above the nozzle surface of the liquid ejecting head 52.

A top wall portion of the flow channel forming member 125 is blocked by the plate-shaped member 41. In other words, the flow channel forming member 125 in association with the plate-shaped member 41 is configured to form the flow channels between the plurality of throttle portions 124 (plurality of slit portions 126) and the plurality of ventilation fans 123 (plurality of ventilation ports 122) out of the intake/exhaust flow channel R. The flow channel forming member 125 has a width in which the plurality of throttle portions 124 and the plurality of ventilation ports 122 are included, thereby being formed to be manifold causing the plurality of throttle portions 124 to serve as branch flow channels and formed to be manifold causing the plurality of ventilation ports 122 to serve as branch flow channels.

The plurality of ventilation fans 123 are arranged in each of the ventilation ports 122 to be arranged in parallel in the X-axis direction. Each of the ventilation fans 123 is configured to be switchable between normal rotation driving to execute forced air exhaust and reverse rotation driving to execute forced air intake. The forced air exhaust denotes that air in the intake/exhaust flow channel R is forcibly discharged outside the apparatus such that air flows from the opening 121 side toward the ventilation port 122 side in the intake/exhaust flow channel R due to the forced air exhaust. Meanwhile, the forced air intake denotes that air outside the apparatus is forcibly taken into the intake/exhaust flow channel R such that air flows from the ventilation port 122 side toward the opening 121 side in the intake/exhaust flow channel R due to the forced air intake.

Figure 10A:
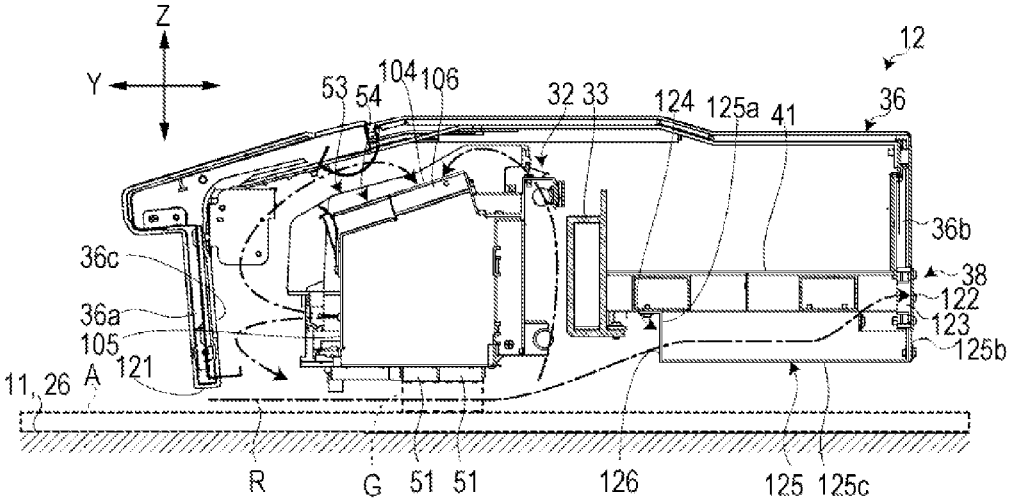
FIG. 10A is a view illustrating an air flow generated during a recording operation.
Figure 10B:
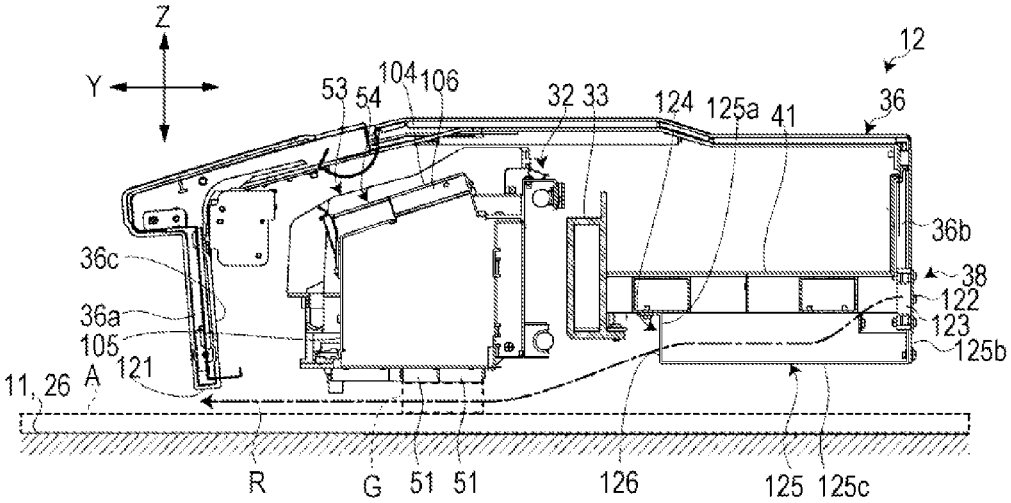
FIG. 10B is a view illustrating the air flow generated during a standby.
Figure 11A:
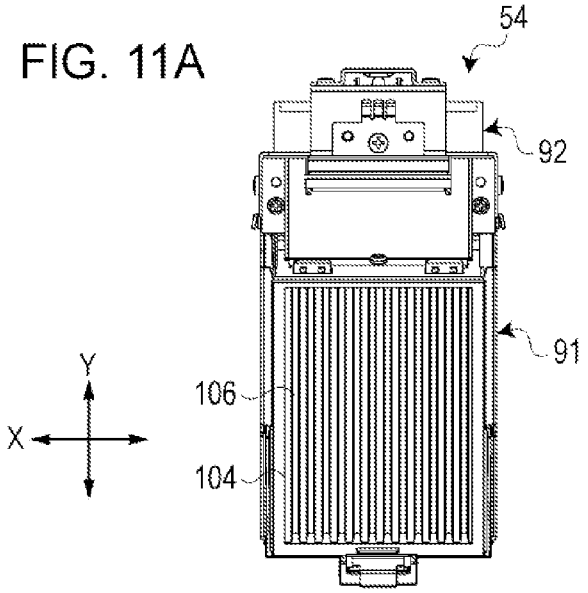
FIG. 11A is a plan view illustrating an ultraviolet irradiation unit.
Figure 11B:
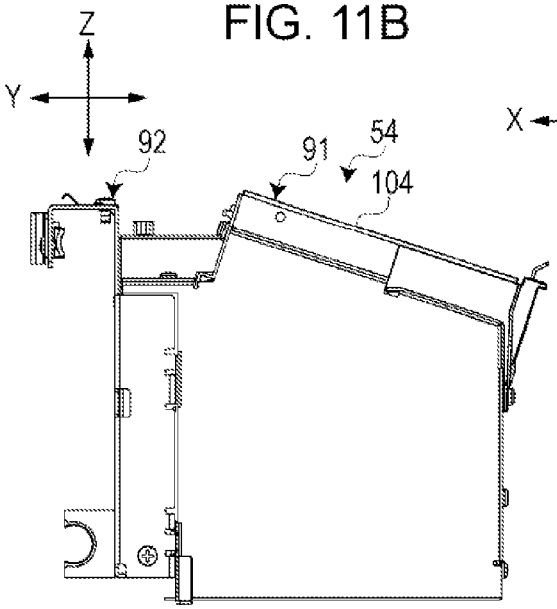
FIG. 11B is a side view thereof.
Figure 11C:
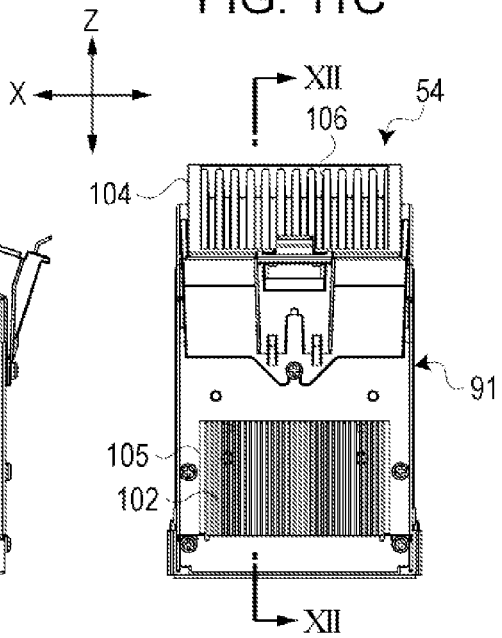
FIG. 11C is a front view thereof.
Figure 12:
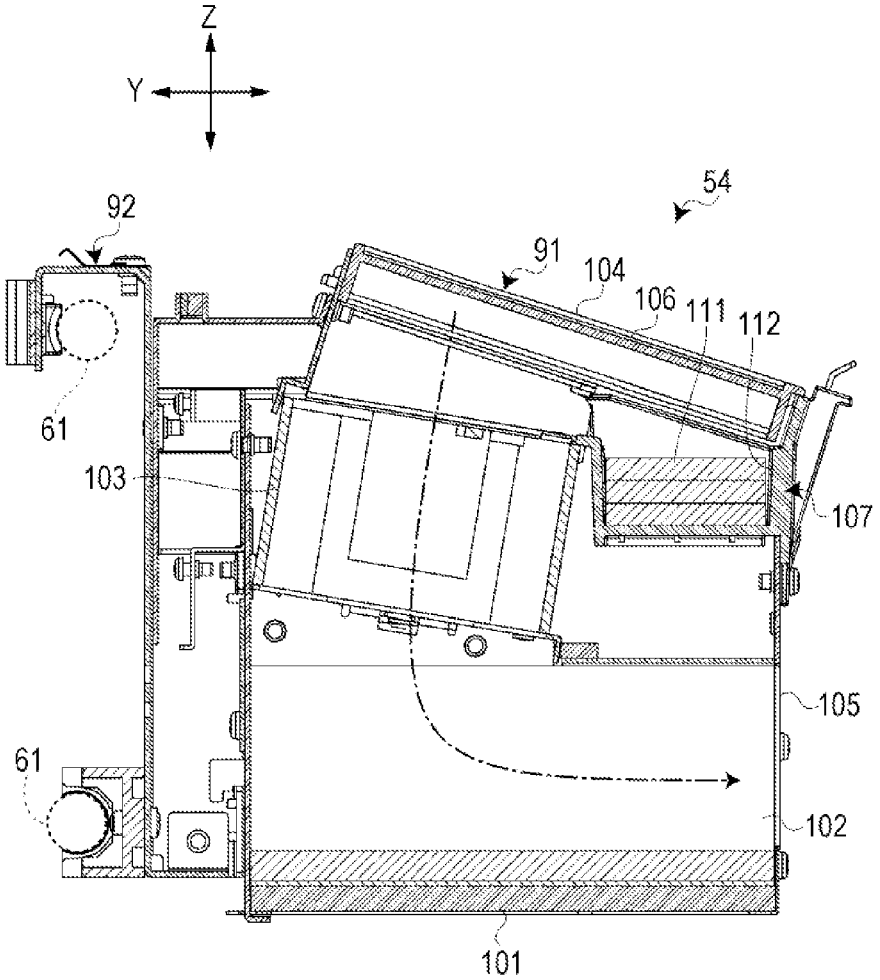
FIG. 12 is a cross-sectional view taken along line XII-XII illustrating the ultraviolet irradiation unit.

During the forced air exhaust, since the air flow is generated from the opening 121 to the plurality of ventilation ports 122, the throttle portion 124 is positioned on the downstream side of the gap space G (refer to FIG. 10A). In contrast, during the forced air intake, since the air flow is generated from the plurality of ventilation ports 122 to the opening 121, the throttle portion 124 is positioned on an upstream side of the gap space G (refer to FIG. 10B). Accordingly, the flow velocity of the air flow around the gap space G is increased by the throttle portion 124 during the forced air intake so that the air flow of the faster flow velocity is generated around the gap space G than the forced air exhaust. In other words, while being under control by the controller 14, it is possible to execute the ventilation around the gap space G in a breeze mode in which the air flow of the slow flow velocity is generated around the gap space G by executing the forced air exhaust and in a strong wind mode in which the air flow of the fast flow velocity is generated around the gap space G by executing the forced air intake. When ventilating through the ventilation portion 38, exhaust air of the ultraviolet irradiation unit 54 is also discharged outside the apparatus, thereby exhibiting a function of exhaust heat as well.

As illustrated in FIGS. 11A, 11B, 11C and 12, each of the ultraviolet irradiation units 54 has an irradiation unit main body 91 and, an attachment member 92 which is arranged on a rear side of the irradiation unit main body 91 and attaches the irradiation unit main body 91 to the pair of guide axes 61 in a slidable manner.

The irradiation unit main body 91 includes an ultraviolet irradiation portion (electromagnetic wave irradiation portion) 101 confronting the recording medium A, a fin-type heat sink 102 which is arranged on an upper side of the ultraviolet irradiation portion 101 and cools the ultraviolet irradiation portion 101, a cooling fan 103 which is arranged on an upper side of the heat sink 102 and generates the air flow passing through (taking heat from) the heat sink 102, and an intake port 104 and an exhaust port 105 which are arranged on upper and lower front sides and perform the intake and discharge. The ultraviolet irradiation portion 101 is constituted of a plurality of ultraviolet irradiation LEDs which irradiate ultraviolet rays (electromagnetic waves) and arranged downward in a lower portion of the irradiation unit main body 91. Each of the ultraviolet irradiation units 54 cures (fix) the ultraviolet curing ink ejected through the liquid ejecting head 52 by emitting the ultraviolet ray from the ultraviolet irradiation portion 101.

The irradiation unit main body 91 is arranged in the intake port 104 and has a filter (capturing portion) 106 which captures the ink mist, and an ink storage portion 107 facing a lower end portion of the filter 106. In the irradiation unit main body 91, an L-shaped inner flow channel is formed from the intake port 104 to the exhaust port 105, and the intake port 104 and the filter 106, the fan 103, the heat sink 102 and the exhaust port 105 are arranged from the upstream side in the listed order. If the fan 103 is driven, an atmosphere including the ink mist is taken in from the intake port 104, thereby discharging from the exhaust port 105 through the filter 106 and the heat sink 102. In this manner, the ultraviolet irradiation unit 54 takes in the atmosphere around the liquid ejecting unit 53 so as to function as the mist collecting portion which captures and discharges the ink mist.

The intake port 104 is arranged in the upper portion of the irradiation unit main body 91 to be arranged upward and forward, that is, obliquely upward. Meanwhile, the exhaust port 105 is arranged on a front side of the lower portion of the irradiation unit main body 91 to be arranged forward. As illustrated in FIG. 8, a wall surface (facing portion) 36*c* of the front surface wall 36*a* in the apparatus cover 36 is configured to face the exhaust port 105.

The filter 106 is arranged on the intake port 104 to be arranged in an obliquely upward posture following the intake port 104. The filter 106 extends forward to a directly upper portion of the ink storage portion 107.

The ink storage portion 107 is arranged to face the lower end portion of the filter 106. The ink storage portion 107 has a storage container 111 which receives and stores the ink, and an absorber 112 which fills the storage container 111. If the filter 106 captures the ink mist and the ink is accumulated in the filter 106, the accumulated ink gathers in the lower end portion of the filter 106 and reaches the ink storage portion 107, thereby being stored thereafter.

Figure 13:
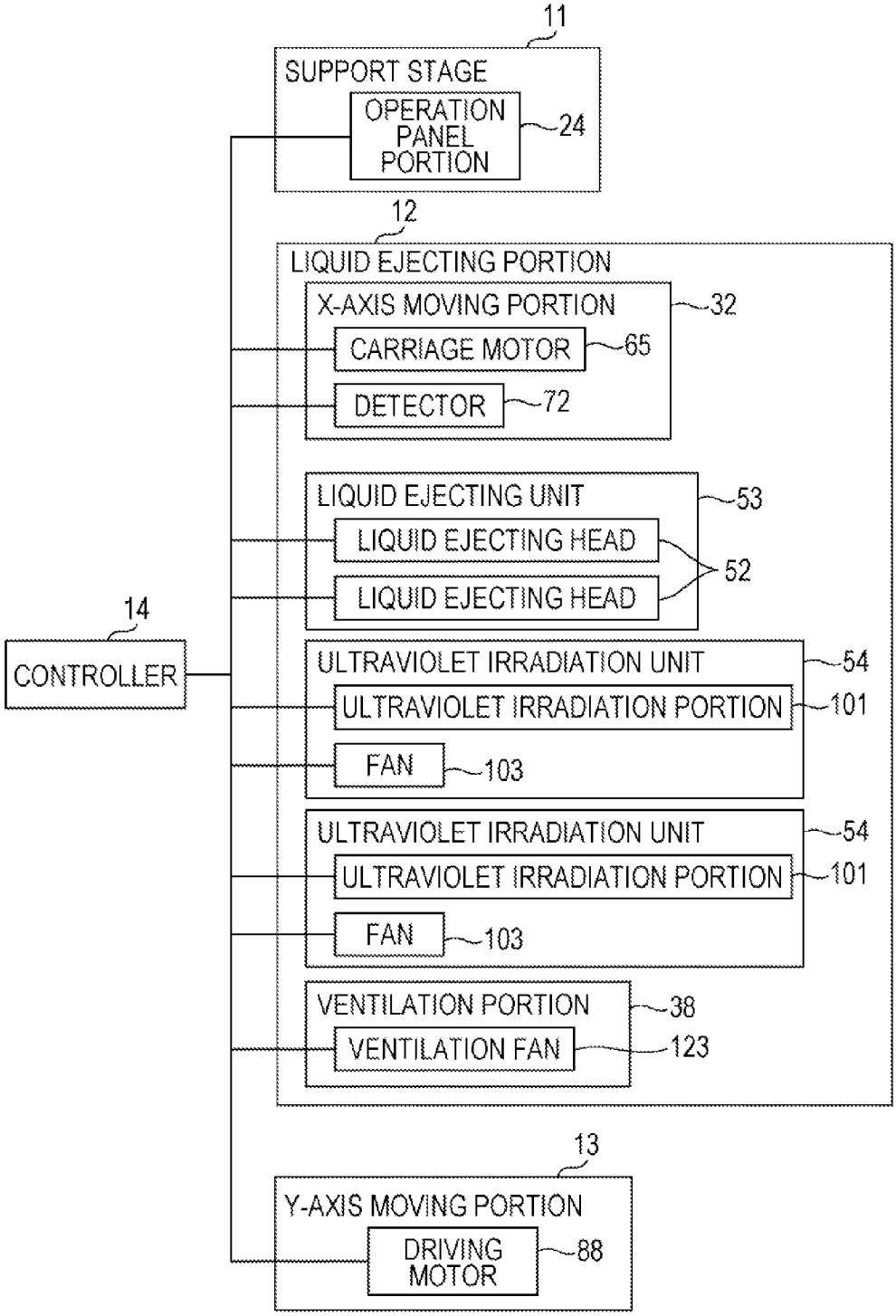
FIG. 13 is a block diagram of controlling illustrating a control configuration of the liquid ejecting apparatus.

FIG. 13 is a block diagram of controlling illustrating a control configuration of the liquid ejecting apparatus 1. As illustrated in FIG. 13, the controller 14 is connected to the support stage 11, the liquid ejecting portion 12 and the Y-axis moving portion 13. The controller 14 receives operational information from the operation panel portion 24 operated by a user and receives a detection result (moving position) from the detector 72 of the X-axis moving portion 32. Meanwhile, the controller 14 controls the carriage motor 65 of the X-axis moving portion 32, two liquid ejecting heads 52 of the liquid ejecting unit 53, the ultraviolet irradiation portion 101 and the fan 103 of each ultraviolet irradiation unit 54, the ventilation fan 123 of the ventilation portion 38, and the driving motor 88 of the Y-axis moving portion 13, thereby executing the recording operation.

During the recording operation, the controller 14 causes the ventilation fan 123 to be in the normal rotation driving and drives each fan 103 of each ultraviolet irradiation unit 54. The controller 14 intermittently moves the liquid ejecting portion 12 from the front side to the rear side using the Y-axis moving portion 13 (starts new line). At the time of each stop while intermittently moving in the Y-axis direction, the liquid ejecting portion 12 moves the head unit 31 in the X-axis direction using the X-axis moving portion 32 as emitting the ultraviolet rays from the ultraviolet irradiation portion 101, thereby ejecting the ink from the liquid ejecting head 52 (recording process). Accordingly, a desired image is recorded with respect to the recording medium A.

During the recording operation, the pair of ultraviolet irradiation units 54 reciprocates in the X-axis direction together with the liquid ejecting unit 53 in a state where each of the fans 103 is driven. Therefore, the ink mist is collected by the pair of ultraviolet irradiation units 54 in the entire region over the liquid ejecting portion 12 (inside apparatus cover 36) in the X-axis direction. In other words, a mist collecting operation is executed together with the recording operation in the configuration.

During the recording operation, the air flow from the front side to the rear side is generated with respect to the surroundings of the gap space G by the normal rotation driving (forced air exhaust: breeze mode) of each of the ventilation fans 123, and the atmosphere above the liquid ejecting portion 12 is taken in from the upper side and discharges to the front side in the ultraviolet irradiation unit 54 by driving each of the fans 103. According to these, as illustrated in FIG. 10A, an air flow which flows above from the exhaust port 105 of the ultraviolet irradiation unit 54 as drawing an arc and reaches the intake port 104 of the ultraviolet irradiation unit 54, and an air flow which flows below from the exhaust port 105 of the ultraviolet irradiation unit 54 as drawing an arc and reaches the surroundings of the gap space G are generated. The ink mist on the former air flow is collected by the ultraviolet irradiation unit 54 and the ink mist on the latter air flow is moved downwind of the air flow generated by the ventilation fan 123 to be removed to the outside of the apparatus. As illustrated in the same drawing, the ink mist moving downwind of the air flow generated by the ventilation fan 123 is partially diverged to flow between the head unit (liquid ejecting unit 53 and the ultraviolet irradiation unit 54) and the X-axis moving portion 32. However, this ink mist also reaches the intake port 104 of the ultraviolet irradiation unit 54 to be collected.

In the embodiment, when a recording execution is directed from the operation panel portion 24, a detecting operation is executed prior to the recording operation. In other words, the recording medium A is mounted on the support stage 11 by the user in a state where the liquid ejecting portion 12 is arranged on the rear side of the X-axis direction (standby position side when recording medium A is set). Then, the user directs the recording execution through the operation panel portion 24 in the state where the recording medium A is mounted (supported) on the support stage 11. If the recording execution is directed, the controller 14 moves the liquid ejecting portion 12 to the front side in the X-axis direction (operation panel portion 24 side) using the Y-axis moving portion 13. In this case, while the head unit 31 moves from the rear side in the X-axis direction to the front side in the X-axis direction, an obstacle detector (not illustrated) disposed in the liquid ejecting portion 12 detects contact between the liquid ejecting portion 12 and an obstacle, or whether or not there is the obstacle which may come into contact with the head unit 31. The detecting operation is executed in this manner. The obstacle detector detects whether or not there is possibility of contact between the recording medium A and the head unit 31, or whether or not there is the obstacle which may come into contact with the head unit 31 on the recording medium A or the support stage 11.

When an obstacle is detected through this detecting operation, the controller 14 stops the movement of the liquid ejecting portion 12 to the front side in the Y-axis direction and notifies the user of an error. Meanwhile, when no obstacle is detected while moving the liquid ejecting portion 12 from the rear side to the front side in the Y-axis direction, the controller 14 determines that there is no obstacle and moves the liquid ejecting portion 12 to a predetermined position on the other direction side of the Y-axis direction (recording start position side), thereby stopping the liquid ejecting portion 12 temporarily. After the temporary stop, the liquid ejecting portion 12 is moved from the front side in the Y-axis direction (recording start position side) to the rear side, thereby starting the recording operation.

In the description of the recording operation, although there is described that "the ventilation fan 123 is in the normal rotation driving during the recording operation", specifically, during the recording work including the recording operation and the detecting operation, the ventilation fan 123 is in the normal rotation driving. The term "during recording work" denotes a period from when the recording execution is directed until recording ends with respect to one recording medium A including "during recording operation" and "during detecting operation". In other words, during the recording work, the controller 14 causes the ventilation fan 123 to be in the normal rotation driving, thereby executing the forced air exhaust (refer to FIG. 10A). Accordingly, during the recording work, the ventilation around the gap space G is executed in the breeze mode. Meanwhile during a standby (after ending recording for one recording medium A and before directing recording execution: not in recording work), the ventilation fan 123 is in the reverse rotation driving, thereby executing the forced air intake (refer to FIG. 10B). Accordingly, during the standby, the ventilation is executed around the gap space G in the strong wind mode. During the standby, that is, during the ventilation in the strong wind mode, it is preferable that the head unit 31 be retreated to a home position in a right end in the X-axis direction.

According to the configuration described above, during the recording operation, since the removal of the ink mist to the outside of the apparatus is performed with the capturing of the ink mist inside the apparatus by the ventilation portion 38 and each ultraviolet irradiation unit (mist collecting portion), it is possible to effectively remove the ink mist above the liquid ejecting portion 12 throughout the wide range. Particularly, it is possible to stably detect the moving position of the head unit 31 by the X-axis detecting mechanism 67 without allowing the ink to adhere to the linear scale 71.

Since the discharging side of the ultraviolet irradiation unit 54 faces the wall surface 36*c* of the apparatus cover 36, the exhaust of the ultraviolet irradiation unit 54 is branched upward and downward by colliding to the wall surface 36*c* of the apparatus cover 36, and thus, it is possible to suitably generate the air flow which circulates inside the apparatus cover 36 about the ultraviolet irradiation unit 54. Accordingly, it is possible to effectively remove the ink mist.

Two ultraviolet irradiation units 54 are provided to be adjacent to the liquid ejecting unit 53 which is an origin of generating the ink mist, and thus, it is possible to more effectively collect the ink mist which has just generated.

In the embodiment, although the recording operation and the mist collecting operation are configured to be executed together, a mist collecting mode may be configured to be included to perform the mist collecting operation without performing the recording operation. Specifically, the controller 14 switches the execution mode between the recording process mode (first mode) to execute both the recording operation and the mist collecting operation, and the mist collecting mode (second mode) to execute the mist collecting operation without executing the recording operation in accordance with the operation of the user. In the mist collecting mode, the head unit 31 (liquid ejecting unit 53 and pair of ultraviolet irradiation unit 54) is reciprocated in the X-axis direction using the X-axis moving portion 32 in a state where the controller 14 does not drive the liquid ejecting head 52, does not irradiate the ultraviolet rays from the ultraviolet irradiation portion 101 while causing the ventilation fan 123 to be in the reverse rotation driving (strong wind mode) and driving each of the fans 103. According to this configuration, it is possible to collect the ink mist above the liquid ejecting portion 12 even when there is no need to perform the recording operation.

In the embodiment, although two ultraviolet irradiation units 54 are provided to be adjacent to both the front and rear sides of the liquid ejecting unit 53, only one of the ultraviolet irradiation unit 54 may be configured to be provided.

In the embodiment, although the ultraviolet irradiation unit 54 is configured to function as the mist collecting portion, the mist collecting unit may be configured to be provided without an ultraviolet irradiation function in place of the ultraviolet irradiation unit 54. Specifically, the mist collecting unit is configured to include the fan 103, the intake port 104, the exhaust port 105, the filter 106 and the ink storage portion 107 without including the ultraviolet irradiation unit 54, ultraviolet irradiation portion 101, and the heat sink 102.

In the embodiment, although the intake port 104 is configured to be arranged obliquely upward, the intake port 104 may be configured to be arranged upward, for example.

In the embodiment, in the configuration, although the exhaust port 105 is arranged forward such that the ultraviolet irradiation unit 54 discharges the taken atmosphere forward, the exhaust port 105 may be arranged toward the rear side such that the ultraviolet irradiation unit 54 discharges the taken atmosphere rearward in the configuration. Two exhaust ports 105 may be included toward the front/rear side such that the ultraviolet irradiation unit 54 discharges the taken atmosphere toward the front/rear side.

In the embodiment, the ventilation fan 123 may be configured to be provided with a ventilation filter in either side of the front or rear (upstream/downstream side).

In the embodiment, although the aspect is applied to the liquid ejecting apparatus 1 which moves the head unit 31 in an XY-direction for recording, the aspect may be configured to apply the head unit 31 with a line head to the liquid ejecting apparatus 1 (so-called line printer) which performs recording by moving in only the Y-axis direction.

In the embodiment, the X-axis direction is a so-called main scanning direction, and the Y-axis direction is a so-called sub scanning direction.

In the embodiment, although the ventilation fan 123 is configured to be arranged on the ventilation port 122 side, the ventilation fan 123 may be configured to be arranged on the opening 121 side. The ventilation fan 123 may be configured to be arranged on both the ventilation portion 122 and the opening 121 side.

In the embodiment, although the direction of the air flow in the intake/exhaust flow channel R is switched in the configuration by switching the normal/reverse rotation driving of the ventilation fan 123, the direction of the air flow may be switched in the configuration by opening/closing control with respect to two ducts of which flow channels are connected to the ventilation fan 123. For example, a first duct of which the flow channel is connected to the ventilation fan 123 to discharge air from the opening 121 side toward the ventilation port 122 side, and a second duct of which the flow channel is connected to the ventilation fan 123 to discharge air from the ventilation port 122 side toward the opening 121 side are configured to be additionally included, thereby switching the direction of the air flow by controlling the opening/closing of each duct.

In the embodiment, the ventilation fan 123 is adopted as the air flow generation portion in the configuration without being limited thereto. For example, various air pumps may be adopted as the air flow generation portion in the configuration. As the method of generating an air flow, for example, a method of generating an air flow by moving a plate-shaped member back and forth such as a round fan or a folded fan through compressing/expanding air, or a method of generating an air flow by generating a temperature difference in air using a heater of a cooling device is conceived.

In the embodiment, during the reverse rotation driving of each ventilation fan 123, the throttle portion 124 interposed by the flow channel between each ventilation fan 123 and the gap space G is adopted as the flow velocity increase portion which increases the flow velocity of the air flow around the gap space G without being limited thereto. For example, a fan may be adopted to be arranged as the flow velocity increase portion such that the air flow generated by the reverse rotation driving of each ventilation fan 123 is increased in velocity.

In the embodiment, the aspect is applied to the recording apparatus using the ultraviolet curing ink. However, the aspect may be applied to a recording apparatus using an ink which is cured by irradiating infrared rays of microwaves as a recording apparatus using the electromagnetic wave curing ink. The aspect may be applied to a recording apparatus using general water-based ink and oil-based ink, a gel ink, a hot melt ink and the like as an ink without limited to the recording apparatus using the electromagnetic wave curing ink.

In the embodiment, although the aspect is applied to a recording apparatus which ejects an ink (printer), the aspect may be applied to the liquid ejecting apparatus which ejects a liquid (liquid droplet) in addition to the ink. For example, the aspect may be applied in the configuration to a liquid ejecting apparatus which eject a liquid (functional fluid) containing a material such as an electrode material or a color material in a dispersed or dissolved shape used to manufacture a liquid crystal display, an organic electro-luminescence (EL) and a color filter.

The aspect may be applied to a liquid ejecting apparatus which ejects a living body organic material used to manufacture a biochip, a liquid ejecting apparatus which ejects a liquid used as a precision pipette being a specimen, a textile printing apparatus, or a micro-dispenser.

The aspect may be applied to a liquid ejecting apparatus which ejects a lubricant to a precision machine such as a timepiece, a camera and the like with pinpoint accuracy, a liquid ejecting apparatus which ejects a transparent resin liquid such as an ultraviolet curing resin on a substrate to form a micro-hemisphere (optical lens) used for an optical communication element, and a liquid ejecting apparatus which ejects an etching liquid such as acid or an alkali to perform etching such as the substrate.

As the configuration for ejecting a liquid, a configuration in which the liquid is ejected to be scattered in a state where the liquid is in a granular shape, a configuration in which the liquid is ejected to be scattered in a state where the liquid is in a tear shape, a configuration in which the liquid is ejected to be scattered in a state where the liquid is filamentous with a lasting effect, and the like are conceived.

As the liquid, any liquefied material may be adopted as long as the material can be ejected by the liquid ejecting apparatus. For example, not only a fluid state material and a liquid as a state of a material such as a liquid body with high or low viscosity, a sol, gel water, other inorganic solvent, an organic solvent, a solution, a liquefied resin, liquefied metal (metallic melt) but also a material in which particles of a functional material formed of a solid body such as a pigment or a metal particle is dissolved, dispersed or mixed in a solvent; and the like are conceived.

The entire disclosure of Japanese Patent Application No. 2013-071608, filed Mar. 29, 2013 is expressly incorporated by reference herein.

What is claimed is:

1. A liquid ejecting apparatus comprising:

a stage that has a support surface supporting a medium;

a liquid ejecting unit that ejects a liquid to the medium supported by the stage;

an intake/exhaust portion that has an intake port, an exhaust port, a flow channel which connects the intake port and the exhaust port to communicate with each other, and a capturing portion which captures the liquid;

a support portion that supports the liquid ejecting unit and the intake/exhaust portion;

a moving portion that moves the liquid ejecting unit and the intake/exhaust portion supported by the support portion in a first direction;

a liquid ejecting portion that has the support portion and the moving portion; and an air flow generation portion that causes a gas to flow between the liquid ejecting portion and the support surface, the air flow generation portion selectively directing between the gas flowing towards a gap between the liquid ejecting portion and the support surface and the gas flowing away from the gap, wherein the intake/exhaust portion is supported by the moving portion on one side in a second direction orthogonal to the first direction, wherein the exhaust port is arranged on the other side opposite to one side in the second direction, and wherein the intake port is arranged above the exhaust port.

2. The liquid ejecting apparatus according to claim 1, wherein the liquid ejecting portion includes an apparatus cover which covers the liquid ejecting unit and the intake/exhaust portion, and wherein the apparatus cover has a facing portion which faces the exhaust port.

3. The liquid ejecting apparatus according to claim 1, wherein a plurality of the intake/exhaust portions are included, and wherein the liquid ejecting unit is arranged between the plurality of intake/exhaust portions in the first direction.

4. The liquid ejecting apparatus according to claim 1, wherein the intake/exhaust portion includes:

an electromagnetic wave irradiation portion which cures the liquid having an electromagnetic wave curing characteristic;

a filter which captures the liquid; and a heat sink which is arranged between the filter and the exhaust port and cools the electromagnetic wave irradiation portion.

5. The liquid ejecting apparatus according to claim 1, further comprising:

a controller that switches between a first mode to drive the liquid ejecting unit and the intake/exhaust portion, and a second mode to drive the intake/exhaust portion without driving the liquid ejecting unit.

6. The liquid ejecting apparatus according to claim 5, further comprising:

a flow velocity increasing portion that increases a flow velocity of the gas, wherein the controller drives the flow velocity increasing portion and increases the flow velocity of the gas flowing between the liquid ejecting portion and the support surface in the second mode.

* * * * *